US007307055B2

(12) United States Patent
Cook et al.

(10) Patent No.: US 7,307,055 B2
(45) Date of Patent: Dec. 11, 2007

(54) CLEANING IMPLEMENTS

(75) Inventors: Andrew David Cook, Wallkill, NY (US); Edward Mathew Cooney, Montvale, NJ (US); Michael Vincent Monticello, Paramus, NJ (US)

(73) Assignee: Reckitt Benckiser Inc., Parsippany, NJ (US)

( * ) Notice: Subject to any disclaimer, the term of this patent is extended or adjusted under 35 U.S.C. 154(b) by 410 days.

(21) Appl. No.: 10/501,177

(22) PCT Filed: Jan. 16, 2003

(86) PCT No.: PCT/GB03/00206

§ 371 (c)(1),
(2), (4) Date: Oct. 25, 2004

(87) PCT Pub. No.: WO03/062365

PCT Pub. Date: Jul. 31, 2003

(65) Prior Publication Data

US 2005/0065056 A1 Mar. 24, 2005

(30) Foreign Application Priority Data

Jan. 17, 2002 (GB) ..... 0201002.3

(51) Int. Cl.
*C11D 17/04* (2006.01)
*C11D 1/83* (2006.01)
*B08B 1/00* (2006.01)

(52) U.S. Cl. ..... 510/438; 510/108; 510/219; 510/238; 510/395; 510/400; 510/439; 134/42

(58) Field of Classification Search ..... 510/108, 510/219, 238, 395, 400, 438, 439; 134/42
See application file for complete search history.

(56) References Cited

U.S. PATENT DOCUMENTS

| | | | | |
|---|---|---|---|---|
| 2,779,465 | A | 1/1957 | Anderson | 206/47 |
| 3,965,518 | A | 6/1976 | Muoio | 15/104.93 |
| 5,055,216 | A | 10/1991 | Johnson | 252/91 |
| 5,639,532 | A | 6/1997 | Wells | 428/95 |
| 5,763,332 | A * | 6/1998 | Gordon et al. | 442/84 |
| 5,900,068 | A | 5/1999 | Thomas | 134/6 |
| 6,267,975 | B1 * | 7/2001 | Smith et al. | 424/401 |
| 6,683,041 | B1 * | 1/2004 | Nissing et al. | 510/438 |
| 7,132,377 | B2 * | 11/2006 | Borgonjon et al. | 442/74 |
| 2002/0137647 | A1 | 9/2002 | Hackenthal et al. | 510/180 |

FOREIGN PATENT DOCUMENTS

| | | |
|---|---|---|
| DE | 195 03 121 C1 | 8/1996 |
| EP | 1 035 200 A2 | 9/2000 |
| GB | 2 363 704 A | 1/2002 |
| WO | WO 00/27271 | 5/2000 |
| WO | WO 01/09279 A1 | 2/2001 |

* cited by examiner

*Primary Examiner*—Lorna M. Douyon
(74) *Attorney, Agent, or Firm*—Norris McLaughlin & Marcus, P.A.

(57) ABSTRACT

Disclosed herein is a cleaning article as an article of manufacture which includes a substrate onto which a cleaning composition is partially impregnated, leaving a portion of the substrate not impregnated with the composition. The impregnated part or side of the substrate is used to clean surfaces, especially vitro-ceramic surfaces while the unimpregnated part or side of the substrate is then used to dry and buff the cleaned surface.

22 Claims, 3 Drawing Sheets

CLEANING IMPLEMENTS

The present invention relates to a substrate onto which is absorbed a cleaning composition with a scouring action for cleaning hard surfaces in the household and especially for cleaning glass ceramics or vitro-ceramic surfaces, such as cook tops, as well as a process for manufacturing and using the same.

Cleaners for the removal of soils from hard surfaces, e.g., metals, glass, ceramics, synthetic materials, and the like are known. Many types of cleaning products useful for such surfaces are known. Nonetheless certain hard surfaces cannot be treated with many of such products as they deleteriously affected by certain cleaning compositions. For example, surfaces of "soft" glass or of certain synthetic polymers are not appropriately cleaned using certain pasty, liquid or gel cleaning compositions containing certain hard abrasives which may damage such surfaces. A particular surface which cannot be cleaned using many prior art products are glass ceramic cooking surfaces such as are encountered on modern cooking stoves and ranges, in both commercial and in domestic kitchens. Such glass ceramic cooking surfaces, also commonly referred to as "vitro-ceramic" cooking surfaces, may be deleteriously chemically attacked by a certain known art cleaning compositions. Presently, cleaning of typical vitro-ceramic surfaces including vitro-ceramic cooking surfaces requires several steps. These steps often include the following: scraping any excess soil off; applying an appropriate cleaning product to the soiled surface; spreading the cleaning product on the soiled surface, and manually cleaning the surface with a paper towel or other wiping implement. Subsequently, a new paper towel or cleaning implement is needed to remove the excess cleaner and soil. Thereafter, a still further new, clean, dry towel or other wiping article is used to manually buff the treated vitro-ceramic surface to provide a shined, cleaned appearance.

While such vitro-ceramic surfaces including vitro-ceramic cooking surfaces are attractive and coming into greater use, their cleaning and maintenance is troublesome. Accordingly there is a real need in the art for improved cleaning articles which may be used to both clean, and to buff a vitro-ceramic surface which provides for more convenient maintenance of vitro-ceramic surfaces and especially vitro-ceramic cooking surfaces.

It is to these and other objects that the present invention is directed.

In one aspect the present invention provides for an improved cleaning articles which may be used to both clean and to buff a vitro-ceramic surface especially vitro-ceramic cooking surfaces with the said cleaning article. Preferred aspects of the invention eliminate the need for a separate cleaning product and the use of several new towels/wipes in order to achieve effective cleaning and buffing of such vitro-ceramic surfaces.

In another aspect of the invention there is provided an improved method for the treatment of vitro-ceramic surfaces and especially vitro-ceramic cooking surfaces which method contemplates the use of the improved cleaning articles described herein.

Another aspect of the invention relates to the method of manufacturing the improved cleaning articles described herein. Other aspects and advantages of the invention will become more apparent from the following specification.

Figure 1:
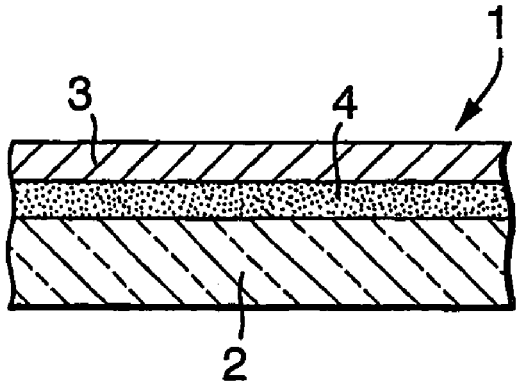
FIG. 1 depicts a cross-section of a cleaning article according to the invention wherein a first portion of the substrate used to form the said article contains a cleaning composition, wherein a second portion of the substrate is essentially dry.

The present invention provides improved cleaning articles comprising a substrate having at least two portions which are separated by liquid impermeable barrier; a first portion of the substrate used to form the said article contains a cleaning composition, wherein a second portion of the substrate is essentially dry. The orientation, sizes or relative areas of the first portion with respect to the second portion of the substrate is not a limiting factor of the invention; it is only required that as part of the substrate there be present a cleaning effective amount of a cleaning composition within the first portion of the substrate and that the second portion of the substrate be essentially dry. By way of non-limiting example, a substrate such as a woven or non-woven wipe or sponge may be generally evenly divided into two portions, wherein the first portion of the substrate contains a cleaning composition, while the second portion of the substrate is essentially dry. Another exemplary substrate such as a woven or non-woven wipe or sponge is where one side or surface forms the first portion of the substrate and that the second portion of the substrate be essentially dry. While these examples describe two embodiments of the substrate useful in the improved cleaning articles according to the present invention, other configurations and arrangements are possible. For example a cleaning article may include a substrate having three or more portions, one (or more) portions of which contains a cleaning composition and can thus be considered as a "first portion", and one (or more) further portions which are essentially dry, and can thus be considered as a "second portion" of the substrate. Thus a substrate may have a plurality of "first portions" and/or a plurality of "second portions". Also, the substrate may include further portions other than the aforesaid first and second portions, which may or may not include a cleaning or other treatment composition. to those areas of the substrate which are to be free of composition. In these and other variations, also present in or upon the substrate is at least one barrier which prevents migration of the cleaning composition from the first portion to the other portions of the substrate, especially to the second portion of the substrate.

The substrate used to form the improved cleaning articles of the invention are preferably flexible, and can be made of any of a number of materials which are known including but not limited to wipes formed from one or more natural fibers, synthetic fibers, or mixtures of natural and synthetic fibers. Exemplary natural fibers include but are not limited to cellulosic fibers, such as wood pulp fibers, cotton, hemp, wool, and rayon. Exemplary synthetic fibers include fibers commonly used in textiles including those formed from spun synthetic polymers, which especially polyester and polypropylene fibers. Various forming methods can be used to form the substrate, such as by nonwoven dry forming techniques, such as air-laying, or alternatively by wet laying, such as on a papermaking machine. Other non-woven manufacturing techniques, including but not limited to techniques such as melt blowing, spunbonding, needle punching, resin bonding, thermally bonding and hydroentanglement, as well as any combination of one or more of these techniques may used. Where wood pulp fibers are combined with one or more synthetic polymer fibers, desirably the wood pulp fibers comprise about 30 to about 60 percent by weight of the substrate material, preferably about 55 to about 60 percent by weight, with the remainder being synthetic fibers. The presence of wood pulp fibers provide for absorbency, abrasion and soil retention whereas the synthetic fibers provide for substrate strength and resiliency and thus wipes containing both these types of fibers are often preferred. The substrates of the cleaning articles according to the invention may also be a porous sponge-type substrate such as those which are derived from synthetic polymers particularly foamed synthetic polymers, from natural sponges as well as sponges formed from or containing cellulose particularly regenerated cellulose sponges. The substrates may also be formed from two or more different materials, e.g., a section formed from a woven or non-woven fibrous substrate, and a section formed from a sponge material. The material used to form the substrate can be smooth or abrasive or may contain abrasive particles imbedded within or formed as part of the substrate. If the substrate is abrasive or contains abrasive particles imbedded within, then the cleaning composition may or may not contain a scouring agent.

The substrates of the cleaning articles according to the invention also includes at least one barrier which prevents migration of the cleaning composition from the first portion to the other portions of the substrate, especially to the second portion of the substrate. The barrier may be formed of any material which is effective in preventing the migration, and in particular the wicking of the cleaning composition from the first portion to other portions of the substrate. Any material which prevents such migration may be used and indeed different configurations of such barriers are possible. In one embodiment wherein the substrate is in a sheet configuration, the barrier is in the form of a relatively small heat sealed strip extending through the substrate. This heat sealed strip is conveniently formed, e.g, by melting a portion of an appropriate substrate. This can be accomplished by having heat sealable materials, for example, polypropylene or polyester fibers, within the substrate so that went a heat source is applied to a designated area of the substrate, an impermeable barrier is formed. This heat sealed strip prevents the migration or wicking from one side or portion containing an absorbed cleaning composition, e.g, the a "first portion" to the other parts of the substrate, e.g, the "second portion" which can remain essentially dry prior to use by a consumer. Alternately, a barrier may be formed by providing a strip or thin layer of a resin (for example, latex, epoxy, and the like) on the substrate, thereby dividing the substrate into at least a first portion and a second portion. Such a resin, when cured, forms an impermeable barrier. In certain preferred embodiments, the barrier may also include perforations within the region of the barrier. The presence of such perforations aids the consumer in folding the cleaning article during use, as well as limits the available volume of the substrate through which the cleaning composition may potentially migrate or "wick" from the first portion.

In yet another embodiment, the substrate is in a sheet configuration and has a first layer which forms the first portion, bonded to a second layer forming the second portion by an intermediate layer of a material, which material forms an impermeable barrier between the first and second portions of the substrate. Any material may be used for form such an intermediate layer, such as a sheet of an impermeable material, such as a synthetic polymer, or a layer of a curable resin as described previously. Such a construction of the substrate prevent migration of the absorbed composition on the front side of the substrate to the back side of the substrate.

FIG. 1 depicts a cross-section of a flexible cleaning article according to the invention wherein a first portion of the substrate used to form the said article contains a cleaning composition, wherein a second portion of the substrate is essentially dry. The flexible cleaning article 1 is an sheet configuration which comprises: a bottom layer 2, which is the first portion and includes a cleaning composition impregnated therein, a top layer 3, which is the second portion and which is essentially dry, and, a barrier 4, which prevents the migration or wicking of the cleaning composition between the bottom layer 2 and the top layer 3.

Figure 2:
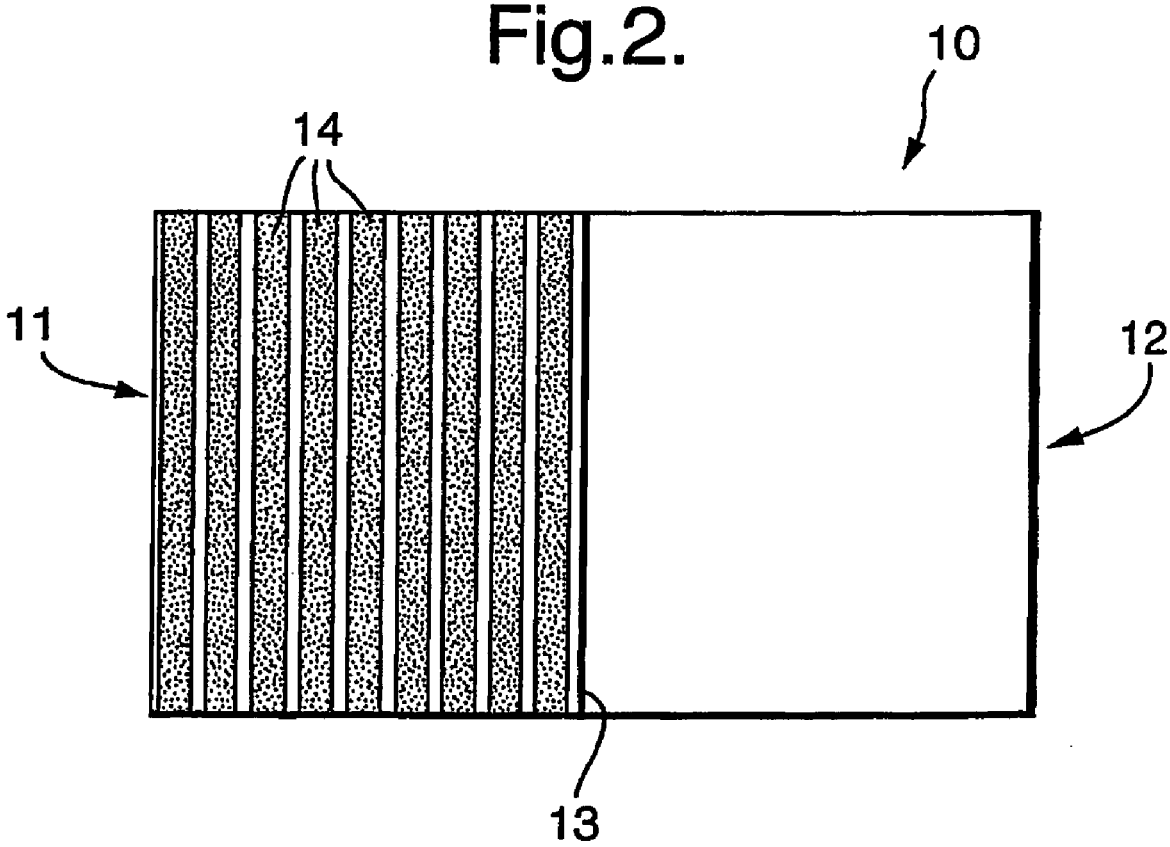
FIG. 2 depicts a further embodiment of a cleaning article according to the invention wherein a first portion of the substrate used to form the said article contains a cleaning composition, wherein a second portion of the substrate is essentially dry.

FIG. 2 depicts a further embodiment of a flexible cleaning article according to the invention wherein a first portion of the substrate used to form the said article contains a cleaning composition, wherein a second portion of the substrate is essentially dry. The cleaning article 10 is also a sheet configuration and comprises: a first side 11, which is the first portion and includes a cleaning composition impregnated therein, a second side 12, which is the second portion and which is essentially dry, and, a barrier 13 dividing the two sides of the cleaning article 10. The barrier 13 may be formed of any material as described previously, and in the embodiment shown in FIG. 2 is a heat sealed strip formed by applying an appropriate heat source to the region of the substrate which melts and fuses to form an impermeable barrier between the first side 11 and the second side 12 of the cleaning article 10. After the formation of the barrier 13, an appropriate amount of a cleaning composition is introduced to the first portion of the cleaning article 10, such as in the form of stripes 14.

Figure 3:
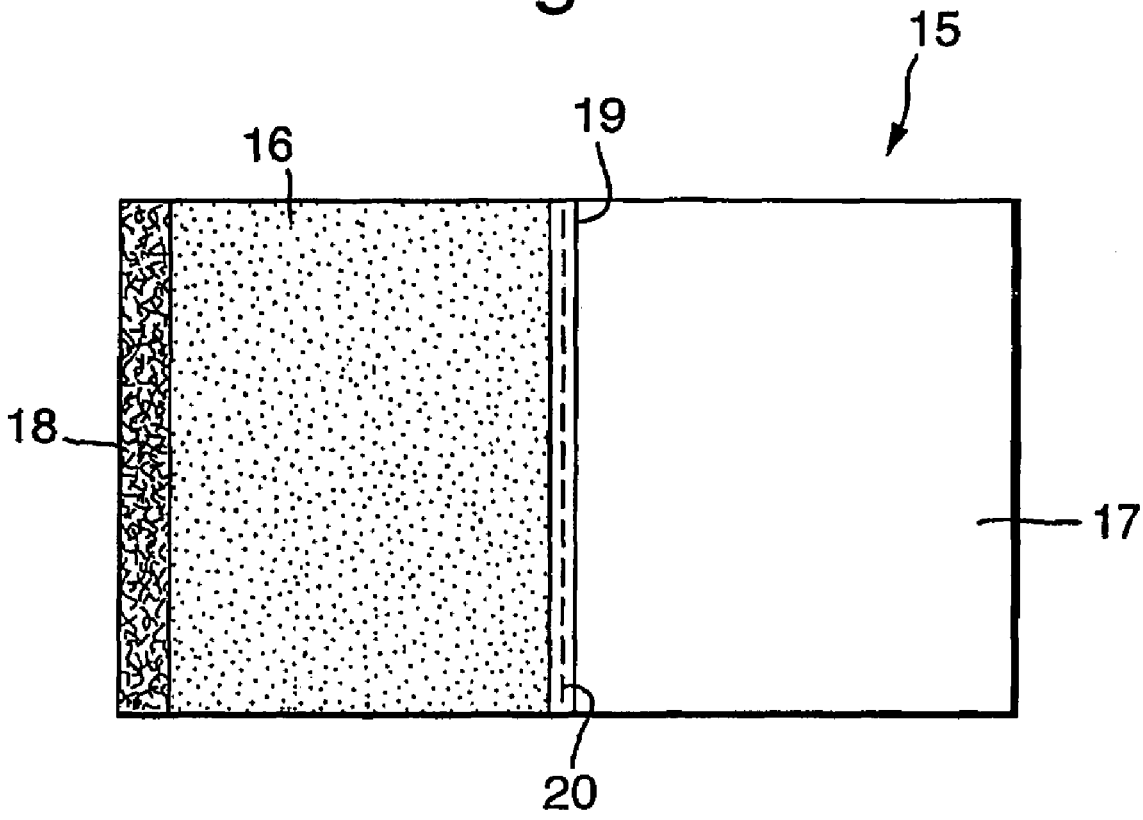
FIG. 3 depicts a still further embodiment of a cleaning article according to the invention wherein a first portion of the substrate used to form the said article contains a cleaning composition, wherein a second portion of the substrate is essentially dry, wherein the first and second portions are separated by a perforated barrier.

FIG. 3 depicts a still further embodiment of a flexible cleaning article 15 according to the invention. The cleaning article 15 is also a sheet configuration, and includes a first side 16 of the substrate contains a cleaning composition, wherein a second side 17 of the substrate is essentially dry, and wherein the first and second sides are separated by a perforated barrier 19. Additionally, a section of the first side 16 further includes an abrasive strip which may be sewn or bonded to the first side 16. The abrasive strip provides a gentle scrubbing surface which facilitates in the removal of soils from a hard surface, without unduly damaging the hard surface. The perforated barrier 19 is a heat sealed strip formed by applying an appropriate heat source to the region or strip of the substrate which melts and fuses to form an impermeable barrier between the first side 11 and the second side 12 of the cleaning article 10. The barrier also includes a series of perforations 20 which disrupt the physical integrity of the substrate. Conveniently these perforations 20 are in the form of a line, but different configurations of perforations are also possible including denser, or less dense arrangements of perforations, as well as plural lines of perforations. The perforations form holes through the substrate, and aid the consumer in folding the cleaning article during use.

Figure 4:
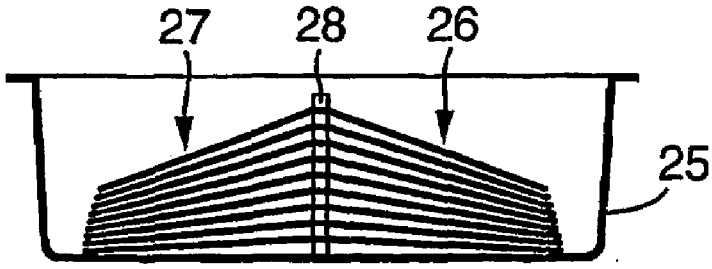
FIG. 4 depicts a cross-sectional view of a plurality of cleaning articles, e.g, according to FIGS. 2 or 3 in a container, illustrating the arrangement of the plurality of wiping articles in a layered stacked configuration.

FIG. 4 depicts a cross-sectional view of a plurality of flexible cleaning articles, e.g, according to FIGS. 2 or 3 in a container, illustrating the arrangement of the plurality of flexible wiping articles in a layered stacked configuration. The container 25 is in the form of a tub, containing a number of flexible cleaning articles 26, which are layered in register, or stacked, such that like sides of each flexible cleaning article are placed adjacent to similarly arranged flexible cleaning article. In this manner, the flexible cleaning articles 26 can be stacked such that all first sides 26 (first portions) are layered in register, all second sides 27 (second portions) are layered in register, with the first 26 and second sides 27 separated by barriers 28 layered in register. Such an arrangement inhibits the migration of cleaning composition from the first side to other parts of the flexible substrate.

Of course it is contemplated that the cleaning articles according to the invention my also be supplied in individual packages, such as sealed pouches which may be breached when it is desired to use the product.

Figure 5:
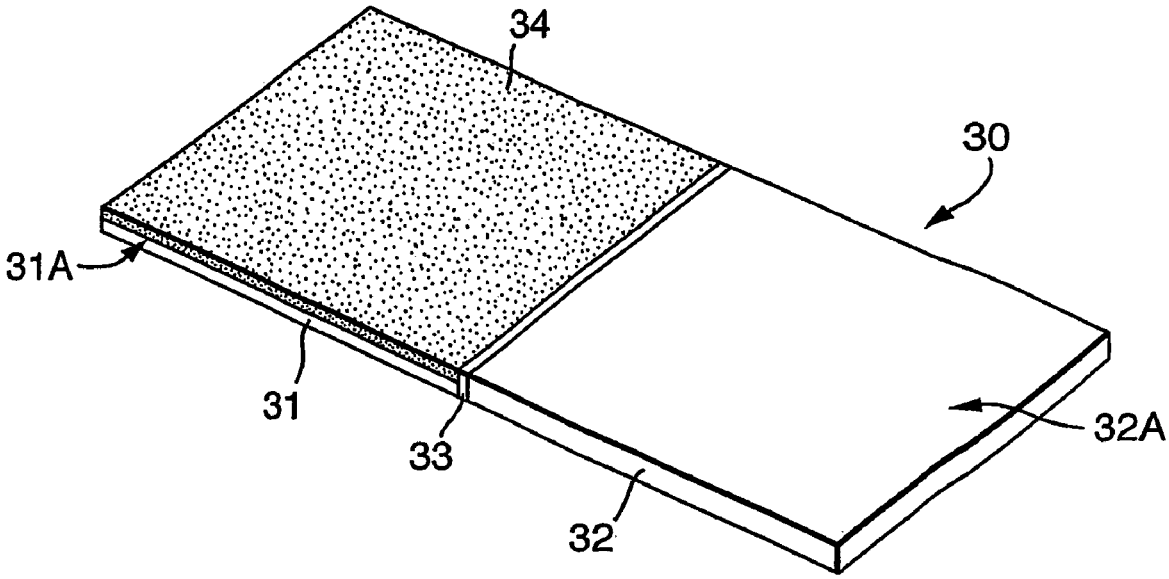
FIG. 5 depicts a still further embodiment of a cleaning article according to the invention wherein a first portion of the substrate used to form the said article contains a cleaning composition, wherein a second portion of the substrate is essentially dry, and where a backing film is applied to the first portion of the substrate.

FIG. 5 depicts a still further embodiment of a cleaning article according to the invention wherein a first portion of the substrate used to form the said article contains a cleaning composition, wherein a second portion of the substrate is essentially dry, and where a backing film is applied to the first portion of the substrate. The cleaning article 30 is provided in a sheet configuration, and includes a first side 31 of the substrate (defining a first portion) contains a cleaning composition, wherein a second side 32 of the substrate (defining a second portion) is essentially dry, and wherein the first 31 and second 32 sides are separated by a (optionally perforated) barrier 33. Additionally, a top surface 31A (not clearly visible in FIG. 5) of the first side 31 further includes an impervious sheet 34 layered in register with the top surface 31A, which impervious sheet 34 forms a barrier to the migration of the cleaning composition impregnated in the first side 31 from the top surface 31A. This impervious sheet 34 may be formed of any material, especially a flexible polymeric material which may be applied, adhered to or otherwise bonded to the top surface 31A of the first side 31. Alternately the impervious sheet 34 may be formed in situ, such as by providing a quantity of a layer of a resin (for example, latex, epoxy, and the like) on a surface of the substrate and permitting it to cure, thereby forming an impermeable barrier. This embodiment of the cleaning article of the invention provides for convenient use by the consumer, who, upon removing the cleaning article 30 from its packaging may fold the cleaning article generally along the barrier 33, so that the top surface 31A is layered with the top surface 32A of the second side 32 of the substrate which interposes the impervious sheet 34 between the first 31 and second 32 sides. The presence of the impervious sheet 34 between the first 31 and second 32 sides acts as barrier for the migration of the cleaning composition from the first portion to the second portion of the substrate. In use, the consumer conveniently grasps the cleaning article 30 by the second side 32, which is essentially dry and applies the cleaning article to a surface, especially a vitro-ceramic surface needing cleaning, and once cleaning is satisfactorily completed, the consumer can flip-over the cleaning article so that the second side 32 faces the cleaned surface, and can be used to polish and buff the surface. Thereafter the cleaning article may be discarded.

In a preferred embodiment of the cleaning article as shown on FIG. 5, the barrier 33 includes perforations (not shown) which can be used to separate the first 31 and second 32 sides of the cleaning article. In use of such an embodiment of the cleaning article, the consumer conveniently grasps the cleaning article 30 by the second side 32, which is essentially dry and applies the cleaning article to a surface, especially a vitro-ceramic surface needing cleaning, and once cleaning is satisfactorily completed, the consumer can separate the first side 31 from the second side 32 and discard the first side 31 which is now soiled. Thereafter, the consumer may used the second side 32 to polish and buff the surface. Thereafter the second side of the cleaning article may be discarded.

While not illustrated in FIG. 5, it is also contemplated that according to certain preferred embodiments of the cleaning article, the impervious sheet 34 layered may be in register with one complete side of the substrate, thereby covering both of the top surfaces 31A and 32A.

Figure 6:
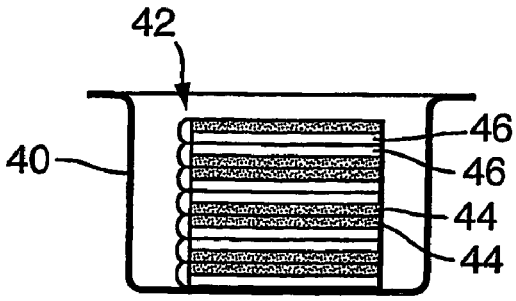
FIG. 6 depicts a cross-sectional view of a plurality of cleaning articles, e.g., according to FIG. 5 in a container, illustrating the arrangement of the plurality of wiping articles in a layered stacked configuration.

FIG. 6 depicts a cross-sectional view of a plurality of cleaning articles, according to FIG. 5 in a container, illustrating the arrangement of the plurality of wiping articles in a layered stacked configuration. The container 40 is in the form of a tub, containing a number of folded, flexible cleaning articles 42, which are layered in register, or stacked, such that like sides of each folded flexible cleaning article are placed adjacent to similarly arranged folded flexible cleaning article. In this manner, the folded flexible cleaning articles 42 can be stacked such that the first sides 44 (first portions) of adjacent folded flexible cleaning articles 46 are layered in register, and similarly, the second sides 46 (second portions) of adjacent folded flexible cleaning articles 42 are layered in register. In the arrangement shown in FIG. 6, wherein the flexible cleaning articles are of the type shown in FIG. 5, the presence of the barrier and the impervious sheet inhibits the migration of cleaning composition from the first side to other parts of the flexible substrate, although it permits the migration of cleaning composition between the first sides 44 (first portions) of adjacent folded flexible cleaning articles 46.

In a broad aspect, the present invention provides as an article of manufacture a cleaning article comprising a flexible substrate having a first portion, divided by an barrier from a second portion, wherein the first portion contains a cleaning composition, and the second portion is essentially dry. What is to be understood by the term "essentially dry" is that no more than 3% wt., desirably no more than 1.5% wt., yet more desirably not more than 0.5% wt., and most desirably not more than 0.1% wt. of a cleaning composition found in the first portion present in the cleaning article is present in the second portion of the cleaning article prior to its use by a consumer.

In a preferred aspect of the invention there is provided as an article of manufacture a cleaning article comprising a flexible substrate having a first portion, divided by an barrier from a second portion, wherein the first portion contains a cleaning composition, and the second portion is essentially dry, wherein the cleaning composition comprises (preferably consists essentially of):

(a) 0.01-10% wt. of one or more surfactants selected from anionic surfactants, nonionic surfactants, cationic surfactants, amphoteric surfactants and mixtures thereof;

(b) 0-40% wt. of a scouring agent selected from the group consisting of oxides, carbonates, quartzes, siliceous chalk, diatomaceous earth, colloidal silicon dioxide, alkali metasilicates, organic abrasive materials selected from polyolefins, polyethylenes, polypropylenes, polyesters, polystyrenes, acetonitrile-butadiene-styrene resins, melamines, polycarbonates, phenolic resins, epoxies and polyurethanes, abrasive water soluble salts, natural materials selected from rice hulls, corn cobs, and the like, nepheline syenite, or talc and mixtures thereof;

(c) 0-10% wt. of a thickener;

(d) 0-10% wt. of one or more organic solvents;

(e) 0-7% wt. of an organopolysiloxane;

(f) 0-3% wt. of an acid;

(g) 0-5% wt. of one or more optional constituents;

(i) to 100% wt. of water.

The cleaning compositions used in the cleaning articles comprise 0.01-10% wt., preferably 0.1-4%, and more preferably from 0.5-3% wt. of one or more surfactants selected from anionic surfactants, nonionic surfactants, cationic surfactants, amphoteric surfactants and mixtures thereof.

Exemplary nonionic surfactants include known art nonionic surfactant compounds. Practically any hydrophobic compound having a carboxy, hydroxy, amido, or amino group with a free hydrogen attached to the nitrogen can be condensed with ethylene oxide or with the polyhydration product thereof, e.g., polyethylene glycol, to form a water soluble nonionic surfactant compound. Further, the length of the polyethenoxy hydrophobic and hydrophilic elements may vary. Exemplary nonionic compounds include the polyoxyethylene ethers of alkyl aromatic hydroxy compounds, e.g., alkylated polyoxyethylene phenols, polyoxyethylene ethers of long chain aliphatic alcohols, the polyoxyethylene ethers of hydrophobic propylene oxide polymers, and the higher alkyl amine oxides. Also contemplated as useful are ethoxylated alkyl phenols such as octylphenolethoxylates and nonylphenolethoxylates.

One preferred class of nonionic surfactants are ethoxylated alcohols. The compounds are well known and may be formed by condensation of an alcohol, or mixtures thereof, with sufficient ethylene oxide to produce a compound having a polyoxyethylene. Preferably the number of ethylene oxide units are present in an amount sufficient to insure solubility of the compound in an aqueous composition of this invention or in any dilution thereof. Desirably, the ethoxylated alcohols are produced by condensation of about 4-20, more preferably 6-18 moles of ethylene oxide with 1 mole of the linear primary aliphatic alcohol. The aliphatic alcohol may be linear or may be branched, and may be a primary, secondary or tertiary alcohol (including by way of non-limiting example: decyl alcohol, dodecyl alcohol, tridecyl alcohol, hexadecyl alcohol, octadecyl alcohol, and the like). As known to those skilled in the art, the number of moles of ethylene oxide which are condensed with one mole of aliphatic alcohol depends upon the molecular weight of the hydrophobic portion of the condensation product. The aliphatic alcohols are desirably a primary, secondary or tertiary aliphatic alcohol having about 8-24, and preferably 8-16, carbon atoms. Especially preferably the nonionic surfactant of the present inventive compositions is the condensation product of linear or branched $C_8$-$C_{16}$ aliphatic alcohols, especially $C_8$-$C_{12}$ linear aliphatic alcohols or mixtures thereof, with sufficient ethylene oxide to provide an average of from 6-12 moles of ethylene oxide per molecule, preferably an average of from 6-8 moles of ethylene oxide per molecule.

Another preferred class of nonionic surfactants are amine oxides. One general class of useful amine oxides include alkyl di (lower alkyl) amine oxides in which the alkyl group has about 10-20, and preferably 12-16 carbon atoms, and can be straight or branched chain, saturated or unsaturated. The lower alkyl groups include between 1 and 7 carbon atoms. Examples include lauryl, dimethyl amine oxide, myristyl dimethyl amine oxide, and those in which the alkyl group is a mixture of different amine oxide, dimethyl cocoamine oxide, dimethyl (hydrogenated tallow) amine oxide, and myristyl/palmityl dimethyl amine oxide.

A further class of useful amine oxides include alkyl di (hydroxy lower alkyl) amine oxides in which the alkyl group has about 10-20, and preferably 12-16 carbon atoms, and can be straight or branched chain, saturated or unsaturated. Examples are bis(2-hydroxyethyl) cocoamine oxide, bis(2-hydroxyethyl) tallowamine oxide; and bis(2-hydroxyethyl) stearylamine oxide.

Further useful amine oxides include those which may be characterized as alkylamidopropyl di(lower alkyl) amine oxides in which the alkyl group has about 10-20, and preferably 12-16 carbon atoms, and can be straight or branched chain, saturated or unsaturated. Examples are cocoamidopropyl dimethyl amine oxide and tallowamidopropyl dimethyl amine oxide. Further additional useful amine oxides include those which may be referred to as alkylmorpholine oxides in which the alkyl group has about 10-20, and preferably 12-16 carbon atoms, and can be straight or branched chain, saturated or unsaturated.

Exemplary anionic surfactants include known art nonionic surfactant compounds. These include but are not limited to: alkali metal salts, ammonium salts, amine salts, aminoalcohol salts or the magnesium salts of one or more of the following compounds: alkyl sulfates, alkyl ether sulfates, alkylamidoether sulfates, alkylaryl polyether sulfates, monoglyceride sulfates, alkylsulfonates, alkylamide sulfonates, alkylarylsulfonates, olefinsulfonates, paraffin sulfonates, alkyl sulfosuccinates, alkyl ether sulfosuccinates, alkylamide sulfosuccinates, alkyl sulfosuccinamate, alkyl sulfoacetates, alkyl phosphates, alkyl ether phosphates, acyl sarconsinates, acyl isethionates, and N-acyl taurates. Generally, the alkyl or acyl radical in these various compounds comprise a carbon chain containing 12 to 20 carbon atoms.

Further exemplary anionic surface active agents which may be used include fatty acid salts, including salts of oleic, ricinoleic, palmitic, and stearic acids; copra oils or hydrogenated copra oil acid, and acyl lactylates whose acyl radical contains 8 to 20 carbon atoms.

Particularly useful anionic surface active agents, also known as anionic surfactants include the water-soluble salts, particularly the alkali metal, ammonium and alkylolammonium (e.g., monoethanolammonium or triethanolammonium) salts, of organic sulfuric reaction products having in their molecular structure an alkyl group containing from about 10 to about 20 carbon atoms and a sulfonic acid or sulfuric acid ester group. (Included in the term "alkyl" is the alkyl portion of aryl groups.) Examples of this group of synthetic surfactants are the alkyl sulfates, especially those obtained by sulfating the higher alcohols (C8-C18 carbon atoms) such as those produced by reducing the glycerides of tallow or coconut oil; and the alkylbenzene sulfonates in which the alkyl group contains from about 9 to about 15 carbon atoms, in straight chain or branched chain. Especially valuable are linear straight chain alkylbenzene sulfonates in which the average number of carbon atoms in the alkyl group is from about 11 to 14.

Other anionic surfactants herein are the water soluble salts of: paraffin sulfonates containing from about 8 to about 24 (preferably about 12 to 18) carbon atoms; alkyl glyceryl ether sulfonates, especially those ethers of C8-18 alcohols (e.g., those derived from tallow and coconut oil); alkyl phenol ethylene oxide ether sulfates containing from about 1 to about 4 units of ethylene oxide per molecule and from about 8 to about 12 carbon atoms in the alkyl group; and alkyl ethylene oxide ether sulfates containing about 1 to about 4 units of ethylene oxide per molecule and from about 10 to about 20 carbon atoms in the alkyl group.

Other useful anionic surfactants herein include the water soluble salts of esters of α-sulfonated fatty acids containing from about 0 to 20 carbon atoms in the fatty acid group and from about 1 to 10 carbon atoms in the ester group; water soluble salts of 2-acyloxy-alkane-1-sulfonic acids containing from about 2 to 9 carbon atoms in the acyl group and from about 9 to about 23 carbon atoms in the alkane moiety; water-soluble salts of olefin sulfonates containing from about 12 to 24 carbon atoms; and β-alkyloxy alkane sulfonates containing from about 1 to 3 carbon atoms in the alkyl group and from about 8 to 20 carbon atoms in the alkane moiety.

Particularly preferred alkyl sulfate anionic surfactants useful in forming the compositions of the invention are alkyl sulfates of the formula

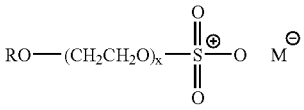

wherein R is an straight chain or branched alkyl chain having from about 8 to about 18 carbon atoms, saturated or unsaturated, and the longest linear portion of the alkyl chain is 15 carbon atoms or less on the average, M is a cation which makes the compound water soluble especially an alkali metal such as sodium, or is ammonium or substituted ammonium cation, and x is from 0 to about 4. Most preferred are the non-ethoxylated C12-15 primary and secondary alkyl sulfates.

Exemplary commercially available alkyl sulfates include one or more of those available under the tradename RHODAPON® from Rhône-Poulenc Co.(Cherry Hill, N.J.) as well as STEPANOL® from Stepan Chemical Co.(Northfield, Ill.). Exemplary alkyl sulfates which is preferred for use is a sodium lauryl sulfate surfactant presently commercially available as RHODAPON® LCP from Rhône-Poulenc Co., as well as a further sodium lauryl sulfate surfactant composition which is presently commercially available as STEPANOL® WAC from Stepan Chemical Co.

Particularly preferred alkyl sulfonate anionic surfactants useful in forming the compositions of the present invention are alkyl sulfonates according to the formula

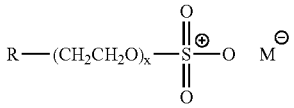

wherein R is an straight chain or branched alkyl chain having from about 8 to about 18 carbon atoms, saturated or unsaturated, and the longest linear portion of the alkyl chain is 15 carbon atoms or less on the average, M is a cation which makes the compound water soluble especially an alkali metal such as sodium, or is ammonium or substituted ammonium cation, and x is from 0 to about 4. Most preferred are the C12-15 primary and secondary alkyl sulfates.

Exemplary, commercially available alkane sulfonate surfactants include one or more of those available under the tradename HOSTAPUR® from Hoechst Celanese. An exemplary alkane sulfonate which is preferred for use is a secondary sodium alkane sulfonate surfactant presently commercially available as HOSTAPUR® SAS from Hoechst Celanese.

Exemplary and preferred cationic surfactants are quaternary ammonium surfactant compounds having germicidal properties. When present the cleaning compositions present in the cleaning articles of the invention include one or more quaternary ammonium surfactant compounds having germicidal properties in amounts sufficient to provide a sanitizing effect. Particularly useful quaternary ammonium compounds and salts thereof include quaternary ammonium germicides which may be characterized by the general structural formula:

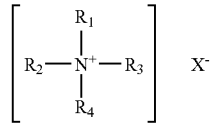

where at least one of $R_1$, $R_2$, $R_3$ and $R_4$ is a hydrophobic, aliphatic, aryl aliphatic or aliphatic aryl radical of from 6 to 26 carbon atoms, and the entire cation portion of the molecule has a molecular weight of at least 165. The hydrophobic radicals may be long-chain alkyl, long-chain alkoxy aryl, long-chain alkyl aryl, halogen-substituted long-chain alkyl aryl, long-chain alkyl phenoxy alkyl, aryl alkyl, etc. The remaining radicals on the nitrogen atoms other than the hydrophobic radicals are substituents of a hydrocarbon structure usually containing a total of no more than 12 carbon atoms. The radicals $R_1$, $R_2$, $R_3$ and $R_4$ may be straight chained or may be branched, but are preferably straight chained, and may include one or more amide or ester linkages. The radical X may be any salt-forming anionic radical.

Exemplary quaternary ammonium salts within the above description include the alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other suitable types of quaternary ammonium salts include those in which the molecule contains either amide or ester linkages such as octyl phenoxy ethoxy ethyl dimethyl benzyl ammonium chloride, N-(laurylcocoaminoformylmethyl)-pyridinium chloride, and the like. Other very effective types of quaternary ammonium compounds which are useful as germicides include those in which the hydrophobic radical is characterized by a substituted aromatic nucleus as in the case of lauryloxyphenyltrimethyl ammonium chloride, cetylaminophenyltrimethyl ammonium methosulfate, dodecylphenyltrimethyl ammonium methosulfate, dodecylbenzyltrimethyl ammonium chloride, chlorinated dodecylbenzyltrimethyl ammonium chloride, and the like.

When present, preferred quaternary ammonium compounds which act as germicides and which are found useful in the practice of the present invention include those which have the structural formula:

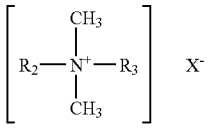

wherein $R_2$ and $R_3$ are the same or different $C_8$-$C_{12}$alkyl, or $R_2$ is $C_{12-16}$alkyl, $C_{8-18}$alkylethoxy, $C_{8-18}$alkylphenolethoxy and $R_3$ is benzyl, and X is a halide, for example chloride, bromide or iodide, or is a methosulfate counterion. The alkyl groups recited in $R_2$ and $R_3$ may be straight chained or branched, but are preferably substantially linear.

In certain particularly preferred embodiments of the invention, the cleaning composition comprises both anionic and nonionic surfactants.

The cleaning compositions used in the cleaning articles comprise 0-40% wt., preferably 2-35%, and more preferably from 5-30% wt., and most preferably from 5-15% wt. of a scouring agent selected from the group consisting of oxides, carbonates, quartzes, siliceous chalk, diatomaceous earth, colloidal silicon dioxide, alkali metasilicates, organic abrasive materials selected from polyolefins, polyethylenes, polypropylenes, polyesters, polystyrenes, acetonitrile-butadiene-styrene resins, melamines, polycarbonates, phenolic resins, epoxies and polyurethanes, abrasive water soluble salts such as sodium sulfate decahydrate, calcium chloride hexahydrate, lithium potassium tartrate natural materials selected from rice hulls, corn cobs, and the like, nepheline syenite, or talc and mixtures thereof A particularly preferred scouring agent is a polyureathane particulate material of which at least 90% wt., preferably at least 95% wt. are particles in the size range of 10-400 microns. Such a material is presently commercially available as "Pur-Mehl F" (ex. Beisswenger GmbH).

Wherein the substrate includes an embedded or incorporated abrasive, (such as certain substrates incorporating abrasives such as a nonwoven wipe material, "5606" ex. Ahistrom Inc.), the scouring agent may be omitted from the cleaning compositions, however, desirably at least a part of the cleaning composition is the scouring agent. If it is desired to prepare a no-residue type of cleaners, an abrasive water soluble salt such as sodium sulfate decahydrate, calcium chloride hexahydrate, lithium potassium tartrate can be used as in the scouring agent of the inventive compositions.

The scouring agents may vary in hardness, particle size and shape, and the choice for a particular composition is generally dependent on the contemplated field of application. The sizes of the abrasive particles are normally less than 0.5 mm., and in general, the maximum particle size of substantially all of the abrasive is under 0.15 mm. In certain preferred embodiments, two (or more) scouring agents having different hardnesses are present in the cleaning compositions. Typically a minor amount of a more abrasive or "harder" scouring is present with a major amount of a less abrasive or "softer" scouring agent(s). Such a combination often provides improved cleaning of soils, with reduced likelihood of scratching cleaned surfaces.

The cleaning compositions used in the cleaning articles comprise 0-10% wt., preferably 0.01-5% wt., more preferably 0.05-3.5% wt., and most preferably from 1-3% wt. of one or more thickening agents in order to modify the viscous and/or thixotropic properties thereof. In especially preferred embodiments of the invention, the cleaning compositions which are impregnated into the first portion of the substrate are thickened so to improve their retention within the substrate. Further the presence of a thickener in the cleaning composition is desirable in providing a means to apply the cleaning composition over a limited area, such as directly onto a stain on a vitro-ceramic surface, without applying an excess onto the surrounding area of the vitro-ceramic surface. Known-art thickening agents may be used. By way of non-limiting example these include natural or modified natural gums are xanthan gum, guar gum, and carob gum, carrageenates, alginates such as sodium alginate and propyleneglycol alginate, cellulose and cellulose derivatives, such as the carboxymethylcelluloses, hydroxyalkylcelluloses, and clays such as bentonite clays, kaolin clays, hydrous silicates, as well as polymeric thickeners such as CARBOPOL® resin materials, as well as and mixtures of two or more thickeners.

The cleaning compositions used in the cleaning articles comprise 0-10% wt., preferably 0.01-7% wt., more preferably 0.05-5% wt., and most preferably from 0.5-4% wt. of one or more organic solvents. Exemplary organic solvents which may be included in the inventive compositions include those which are at least partially water-miscible such as alcohols, ethers, water-miscible ethers (e.g. diethylene glycol diethylether, diethylene glycol dimethylether, propylent glycol dimethylether), water-miscible glycol ether (e.g. propylene glycol monomethylether, propylene glycol mono ethylether, propylene glycol monopropylether, propylene glycol monobutylether, ethylene glycol monobutylether, dipropylene glycol monomethylether, dipropylene glycol monopropyl ether, dipropylene glycol monobutyl ether, diethyleneglycol monobutylether), lower esters of monoalkylethers of ethyleneglycol or propylene glycol (e.g. propylene glycol monomethyl ether acetate) Mixtures of several organic solvents can also be used.

The cleaning compositions used in the cleaning articles comprise 0-7% wt., preferably 0.01-5% wt., more preferably 0.05-3% wt., and most preferably from 0.5-2% wt. of an organopolysiloxane. In particularly preferred embodiments the cleaning compositions comprise at least about 1% wt. of an organopolysiloxane. The organopolysiloxanes are generally supplied as fluids, and are often referred to as silicone fluids and are basically dimethylpolysiloxane fluids, which are substantially linear in nature. The structure of the dimethylsilicone fluid is shown by the following general formula:

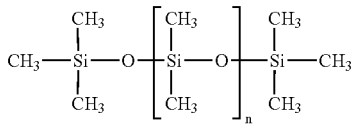

wherein n is the number of repeating groups present. By substitution of some of the methyl groups with other organic or Oregon functional groups, such as vinyl, phenyl, trifluoropropyl, and amino, other organopolysiloxane fluids can be produced, and which may also be used in the inventive compositions. Generally organopolysiloxane fluids are available as mixtures of polymers of varying chain length. It has been found for purposes of the invention that the viscosity of the silicone fluids is a measure of the effectiveness. Silicone fluids can be used which have a viscosity range up to about 100,000 centistokes. Preferably, the viscosity of the silicone fluids to be used should be in the range of from about 300 centistokes up to about 25,000 centistokes, preferably from about 8,000-15,000 centistokes, and most preferably in the range of about 10,000-15,000 centistokes.

Typically such organopolysiloxane fluids, especially dimethylpolysiloxane fluids are provided as aqueous emulsions, and such aqueous emulsions are available from a number of commercial sources. Such aqueous emulsions usually contain from about 35% to about 50% by weight of a silicone fluid or fluid mixture, with the remainder being mostly water and small amounts of emulsifier and adjuvant materials such as a rust inhibitor.

The cleaning compositions used in the cleaning articles comprise 0-3% wt., preferably 0.1-3% wt., more preferably 0.5-2% wt. of an acid. While not essential in all compositions, the present inventors have found that the inclusion of even a minor amount, e.g, at least 0.5% wt. of an acid constituent in the cleaning compositions greatly improves the removal of hard water stains from a surface, particularly a vitro-ceramic surface being treated. The acid may be any water soluble or water dispersible acid, and may be an organic acid or an inorganic acid. Exemplary inorganic acids include hydrochloric acid, sulfamic acid, phosphoric acids as well as other inorganic acids. Particularly useful organic acids include water soluble organic acids having from 1 to 6 carbon atoms, and include at least one carboxyl group (—COOH) in its structure. Particularly useful as water soluble organic acids are formic acid, lactic acid, citric acid, and glycolic acid, and most preferably the acid constituent is citric acid.

The cleaning compositions used in the cleaning articles may comprise 0-5% wt., preferably 0-3% wt %, or one or more conventional optional additives known to the art but not expressly enumerated here may also be included in the compositions according to the invention. By way of non-limiting example without limitation these may include : chelating agents, coloring agents, light stabilizers, fragrances, hydrotropes, pH adjusting agents, pH buffers. Many of these materials are known to the art, per se, and are described in McCutcheon's Detergents and Emulsifiers, North American Edition, 1998; Kirk-Othmer, Encyclopedia of Chemical Technology, 4th Ed., Vol. 23, pp. 478-541 (1997), the contents of which are herein incorporated by reference. Such optional, i.e., non-essential constituents should be selected so to have little or no detrimental effect upon the desirable characteristics of the present invention.

Water is added to the above components in order to provide 100% by weight of the composition. The water may be tap water, but is preferably distilled and is most preferably deionized water. If the water is tap water, it is preferably substantially free of any undesirable impurities such as organics or inorganics, especially minerals salts which are present in hard water which may thus interfere with the operation of the above components as well as any other optional components that may be present.

The cleaning compositions are supplied to the first portion of substrate of the cleaning article by any conventional means, including but not limited to dipping, spraying, dousing and the like. Preferably the barrier is supplied to the substrate prior to or during the application of the cleaning composition to the first portion of the substrate. As noted above, each substrate may have one or more first portions to which a quantity of the cleaning composition is applied. Also as noted, the cleaning article may assume a variety of physical configurations, such as a sheet form having two sides divided by a barrier, or a top layer and bottom layer separated by an intermediate barrier layer. The amount of cleaning composition which may be applied to a cleaning article may vary widely due to a variety of factors including the composition of the substrate and its capacity to absorb the cleaning composition, the viscosity of the cleaning composition as well as other factors. Generally good results are obtained when the cleaning composition is supplied to the first portion of the substrate in an amount of from about 2 to about 5 grams per gram of the substrate material, preferably from about 2 to about 4. grams per gram of the substrate material Alternately, and in certain preferred embodiments the cleaning composition is applied to the substrate in respective weight:weight ratio of cleaning composition:substrate of 1.2-5:1, preferably 1.5-4:1.

In a further aspect there is provided an improved method for the treatment of vitro-ceramic surfaces and especially vitro-ceramic cooking surfaces which method contemplates the use of the improved cleaning articles described herein. A cleaning article is removed from its package, and the first portion of the cleaning article is applied to a soiled surface, especially a vitro-ceramic surface and used to manually spread the cleaning product and clean the soiled surface. The presence of the abrasive within either the cleaning composition or as part of the substrate forming the first portion facilitates the removal of soils. Thereafter, the first portion of the cleaning article is removed, the second portion of the cleaning article is used to manually buff the treated surface to provide a shined, cleaned appearance. Thereafter the cleaning article is discarded. The presence of an organosilicone in the cleaning composition not only provides for good shine to the cleaned surface, but may also provide a protective coating to the cleaned surface, particularly cleaned vitro-ceramic surface. Therefore the inclusion of an organosilicone in the cleaning composition is highly advantageous and preferred.

EXAMPLES

Examples of compositions for use with the present invention are shown in Table 1 below; the amounts of each of the named constituents represent the % wt. of the named constituent in an example formulation, and each of the named constituents were used "as supplied" by their respective manufacturer. The identity of each of the named constituents, including the % actives is indicated on Table 2. Certain of the example compositions illustrate particularly preferred embodiments of the cleaning compositions used in the cleaning articles according to the present invention.

TABLE 1

| | Ex. 1 | Ex. 2 | Ex. 3 | Ex. 4 | Ex. 5 | Ex. 6 | Ex. 7 | Ex. 8 | Ex. 9 |
|---|---|---|---|---|---|---|---|---|---|
| Durcal 15 | 30 | 30 | 30 | 30 | 30 | 30 | 30 | 30 | 30 |
| Empilan KR6 | 2 | 2 | 2 | 2 | 2 | 2 | 2 | 2 | 2 |
| Hostapur SAS 30 | 2 | 2 | 2 | 2 | 2 | 2 | 2 | 2 | 2 |
| Dantogard | 0.2 | 0.2 | 0.2 | 0.2 | 0.2 | 0.2 | 0.2 | 0.2 | 0.2 |

TABLE 1-continued

| | | | | | | | | | |
|---|---|---|---|---|---|---|---|---|---|
| Perfume | 0.4 | 0.4 | 0.4 | 0.4 | 0.4 | 0.4 | 0.4 | 0.4 | 0.4 |
| Laponite RD | 0.5 | 1 | 0 | 0 | 1 | 0 | 1 | 1 | 0 |
| Rhodopol 50-MD | 0.4 | 0.3 | 0.3 | 0.5 | 0.5 | 0.3 | 0.3 | 0.5 | 0.5 |
| isopropanol | 2 | 0 | 4 | 0 | 4 | 0 | 4 | 0 | 4 |
| Rhodorsil 47V 12,500 | 0.78 | 0.05 | 0 | 1.5 | 0.05 | 0.05 | 1.5 | 1.5 | 0.05 |
| Water D.I. | 61.7 | 64.1 | 61.1 | 63.4 | 59.9 | 65.1 | 58.6 | 62.4 | 60.9 |

| | Ex. 10 | Ex. 11 | Ex. 12 | Ex. 13 | Ex. 14 | Ex. 15 | Ex. 16 | Ex. 17 | Ex. 18 |
|---|---|---|---|---|---|---|---|---|---|
| Durcal 15 | 30 | 30 | 30 | 30 | 30 | 30 | 30 | 30 | 22.5 |
| Empilan KR6 | 2 | 2 | 2 | 2 | 2 | 2 | 2 | 2 | 2 |
| Hostapur SAS 30 | 2 | 2 | 2 | 2 | 2 | 2 | 2 | 2 | 2 |
| Dantogard | 0.2 | 0.2 | 0.2 | 0.2 | 0.2 | 0.2 | 0.2 | 0.2 | 0.2 |
| Perfume | 0.4 | 0.4 | 0.4 | 0.4 | 0.4 | 0.4 | 0.4 | 0.4 | 0.4 |
| Laponite RD | 0 | 1 | 0 | 1 | 0 | 0 | 1 | 1 | 1 |
| Rhodopol 50-MD | 0.3 | 0.5 | 0.5 | 0.3 | 0.5 | 0.3 | 0.5 | 0.3 | 0.425 |
| isopropanol | 0 | 0 | 4 | 4 | 0 | 4 | 4 | 0 | 4 |
| Rhodorsil 47V 12,500 | 1.5 | 0.05 | 1.5 | 0.05 | 0.05 | 0.05 | 1.5 | 1.5 | 1.5 |
| Martipol PN-505 | — | — | — | — | — | — | — | — | 7.5 |
| Water D.I. | 63.6 | 63.9 | 59.4 | 60.1 | 64.9 | 61.1 | 58.4 | 62.6 | 58.475 |

| | Ex. 19 | Ex. 20 | Ex. 21 | Ex. 22 | Ex. 23 | Ex. 24 |
|---|---|---|---|---|---|---|
| Durcal 15 | 30 | 30 | 30 | — | — | — |
| Empilan KR6 | 2 | 2 | 2 | 2 | 2 | 2 |
| Hostapur SAS 30 | 2 | 2 | 2 | 2 | 2 | 2 |
| Ammonyx MCO | — | — | — | 2 | — | — |
| Dantogard | 0.2 | 0.2 | 0.2 | — | — | — |
| Copak DT-60 | — | — | — | 0.2 | 0.2 | 0.2 |
| Perfume | 0.4 | 0.4 | 0.4 | — | — | — |
| Laponite RD | 0 | 1 | 0 | — | — | — |
| Bentonite clay | — | — | — | 1 | 1.5 | 1 |
| Kaolin clay | — | — | — | — | — | 5 |
| Citric acid (anhydrous) | — | — | — | 2 | 2 | 2 |
| Rhodopol 50-MD | 0.3 | 0.5 | 0.5 | 0.5 | 0.5 | 0.4 |
| isopropanol | 0 | 0 | 4 | — | — | — |
| Rhodorsil 47V 12,500 | 1.5 | 0.05 | 1.5 | 1 | 0.5 | 0.5 |
| Martipol PN-505 | — | — | — | 5 | — | — |
| polyurethane abrasive | — | — | — | 5 | 5 | 5 |
| diatomaceous earth | — | — | — | — | 5 | — |
| Water D.I. | 63.6 | 63.9 | 59.4 | 86.3 | 81.3 | 81.9 |

TABLE 2

| | |
|---|---|
| Durcal 15 | calcium carbonate (100% wt. actives) |
| Empilan KR6 | nonionic surfactant, C9–11 alcohol ethoxylate, 6 moles of ethoxylation (100% wt. actives) |
| Hostapur SAS 30 | anionic surfactant, C14–17 sulfonate, sodium salt (30% wt. actives) |
| Ammonyx MCO | nonionic amine oxide, (30% wt. actives) |
| Dantogard | proprietary preservative composition |
| Copak DT-60 | proprietary preservative composition |
| Perfume | proprietary fragrance composition |
| Laponite RD | thickener, hydrous sodium lithium magnesium silicate (100% wt. actives) |
| Bentonite clay | thickener, (100% wt. actives) |
| Kaolin clay | thickener, partially calcined kaolinic clay (100% wt. actives) |
| Citric acid (anhydrous) | anhydrous citric acid (100% wt. actives) |
| Rhodopol 50-MD | xantham gum(100% wt. actives) |
| isopropanol | technical grade isopropanol (100% wt. actives) |
| Rhodorsil 47V 12,500 | dimethylpolysiloxane fluid, 12500 centistokes (100% wt. actives) |
| Martipol PN-505 | calcined aluminum oxide (100% wt. actives) |
| polyurethane abrasive | "Pur-Mehl F" polyurethane powder, 96% wt. having 10–400 microns; ex. Beisswenger GmbH (100% wt. actives) |
| diatomaceous earth | diatomaceous earth (100% wt. actives) |
| Water D.I. | deionized water |

To produce a cleaning article for use according to the examples about 3 to about 15 grams, preferably about 5 to about 9, more preferably about 6 to about 8 grams of composition are impregnated onto approximately 120 $cm^2$ of substrate and then cut to size.

Examples of a cleaning article according to the present invention were tested. Testing of a cleaning article of the present invention for scratching showed no negative effects. The cleaning ability of a cleaning agent according to the present invention was comparably good.

We claim:

1. A cleaning article having a sheet configuration comprising a flexible substrate having a first portion, divided by an impermeable barrier extending through the flexible substrate from a second portion, wherein the first portion contains a cleaning composition, and the second portion is essentially dry, wherein the cleaning composition comprises:

(a) 0.01-10% wt. of one or more surfactants selected from anionic surfactants, nonionic surfactants, cationic surfactants, amphoteric surfactants and mixtures thereof;

(b) 2-40% wt. of a scouring agent selected from the group consisting of oxides, carbonates, quartzes, siliceous chalk, diatomaceous earth, colloidal silicon dioxide, alkali metasilicates, organic abrasive materials, abrasive water soluble salts, natural materials, nepheline syenite, talc and mixtures thereof;

(c) 0-10% wt. of a thickener;

(d) 0-10% wt. of one or more organic solvents;

(e) 0.01-7% wt. of an organopolysiloxane;

(f) 0-3% wt. of an acid;

(g) 0-5% wt. of one or more optional constituents;

(i) to 100% wt. of water, wherein the barrier prevents migration of the cleaning composition from the first portion of the cleaning article to the second portion of the cleaning article.

2. The cleaning article of claim 1 wherein the cleaning composition comprises from 0.01-5% wt. of an organopolysiloxane.

3. The cleaning article of claim 1 wherein the cleaning composition comprises an acid.

4. The cleaning article according to claim 1 wherein the cleaning composition comprises both an anionic and a nonionic surfactant.

5. The cleaning article according to claim 1 wherein the cleaning composition comprises 2-35% wt. of a scouring agent.

6. The cleaning article according to claim 1 wherein the cleaning composition comprises 0.01-5% wt. of a thickener.

7. The cleaning article according to claim 1 wherein the cleaning composition comprises 0.01-7% wt. of an organic solvent.

8. A cleaning article according to claim 1 wherein the impermeable barrier is a heat sealed strip extending through the flexible substrate or is a layer or strip of a cured resin on the substrate.

9. A cleaning article according to claim 1 wherein the organic abrasive materials are selected from: polyolefins, polyethylenes, polypropylenes, polyesters, polystyrenes, acetonitrile-butadiene-styrene resins, melamines, polycarbonates, phenolic resins, epoxies and polyurethanes.

10. A cleaning article according to claim 1 wherein the natural materials are selected from rice hulls and corn cobs.

11. A method for the treatment of surfaces, particularly vitroceramic surfaces which method comprises the steps of:

providing a cleaning article according to claim 1;

applying the first portion of the cleaning article to a soiled surface, especially a vitroceramic surface;

manually spreading the cleaning composition and cleaning the soiled surface;

subsequently removing the first portion of the cleaning article from the surface, applying the second portion of the cleaning article to the surface to manually buff the surface to provide a shined, cleaned appearance.

12. A cleaning article having a sheet configuration comprising a flexible substrate having a first portion, divided by an impermeable barrier extending through the flexible substrate from a second portion, wherein the first portion contains a cleaning composition, and the second portion is essentially dry, wherein the cleaning composition consists essentially of:

(a) 0.01-10% wt. of one or more surfactants selected from anionic surfactants, nonionic surfactants, cationic surfactants, amphoteric surfactants and mixtures thereof;

(b) 2-40% wt. of a scouring agent selected from the group consisting of oxides, carbonates, quartzes, siliceous chalk, diatomaceous earth, colloidal silicon dioxide, alkali metasilicates, organic abrasive materials, abrasive water soluble salts, natural materials, nepheline syenite, talc and mixtures thereof;

(c) 0-10% wt. of a thickener;

(d) 0-10% wt. of one or more organic solvents;

(e) 0.01-7% wt. of an organopolysiloxane;

(f) 0-3% wt. of an acid;

(g) 0-5% wt. of one or more optional constituents;

(i) to 100% wt. of water, wherein the barrier prevents migration of the cleaning composition from the first portion of the cleaning article to the second portion of the cleaning article.

13. The cleaning article of claim 12 wherein the organopolysiloxane is present in the cleaning composition in an amount from 0.01-5% wt.

14. The cleaning article of claim 12 wherein the acid is present in the cleaning composition.

15. The cleaning article according to claim 12 wherein the surfactant is a mixture of an anionic and a nonionic surfactant.

16. The cleaning article according to claim 12 wherein the scouring agent is present in the cleaning composition in an amount from 2-35% wt.

17. The cleaning article according to claim 12 wherein the thickener is present in the cleaning composition in an amount from 0.01-5% wt.

18. The cleaning article according to claim 12 wherein the organic solvent is present in the cleaning composition in an amount from 0.01-7% wt.

19. A cleaning article according to claim 12 wherein the impermeable barrier is a heat sealed strip extending through the flexible substrate or is a layer or strip of a cured resin on the substrate.

20. A cleaning article according to claim 12 wherein the organic abrasive materials are selected from: polyolefins, polyethylenes, polypropylenes, polyesters, polystyrenes, acetonitrile-butadiene-styrene resins, melainines, polycarbonates, phenolic resins, epoxies and polyurcthanes.

21. A cleaning article according to claim 12 wherein the natural materials are selected from rice hulls and corn cobs.

22. A method for the treatment of surfaces, particularly vitroceramic surfaces which method comprises the steps of:

providing a cleaning article according to claim 12;

applying the first portion of the cleaning article to a soiled surface, especially a vitroceramic surface;

manually spreading the cleaning composition and cleaning the soiled surface;

subsequently removing the first portion of the cleaning article from the surface, applying the second portion of the cleaning article to the surface to manually buff the surface to provide a shined, cleaned appearance.

* * * * *